US006450720B1

(12) United States Patent
Cai

(10) Patent No.: US 6,450,720 B1
(45) Date of Patent: Sep. 17, 2002

(54) APPLICATOR AND METHOD FOR APPLYING FLUID OR PASTE PRODUCT TO TARGETED SURFACE

(76) Inventor: Edward Zhihua Cai, 4767 NW. Jeanice Pl., Corvallis, OR (US) 97330

( * ) Notice: Subject to any disclaimer, the term of this patent is extended or adjusted under 35 U.S.C. 154(b) by 0 days.

(21) Appl. No.: 09/579,772

(22) Filed: May 26, 2000

(51) Int. Cl.[7] ..... B43K 29/00

(52) U.S. Cl. ..... 401/193; 401/126; 401/129; 401/194; 401/187; 132/216; 132/218

(58) Field of Search ..... 401/118, 126, 401/121, 122, 129, 194, 125, 187, 188 R, 193, 127; 132/319, 75, 216, 218, 143

(56) References Cited

U.S. PATENT DOCUMENTS

| | | | | |
|---|---|---|---|---|
| 4,033,364 A | | 7/1977 | Inzana | |
| 5,016,658 A | | 5/1991 | Green | |
| 5,050,624 A | | 9/1991 | Kobe | |
| 5,121,763 A | * | 6/1992 | Kingsford | 401/127 |
| 5,178,170 A | | 1/1993 | Kassai | |
| 5,285,799 A | | 2/1994 | Minard | |
| 5,311,888 A | | 5/1994 | Leigh | |
| 5,538,161 A | * | 7/1996 | Koehler et al. | 401/194 |
| 5,890,499 A | | 4/1999 | Fuente | |
| 6,039,483 A | * | 3/2000 | Szekely | 401/194 |

* cited by examiner

*Primary Examiner*—David J. Walczak

(57) ABSTRACT

An applicator for applying fluid or paste product to hair or hair-like objects on a surface comprises a handle, an application member for holding an amount of product and applying the product to the objects, and a shield for covering at least part of the application member to prevent the surface from contacting the application member during the use of the applicator, thereby preventing the surface from being contaminated by the product. The shield has at least one opening configured to allow the hair or hair-like objects to reach the product on the application member, thereby causing the objects to be coated by the product. A product loading system is used to load an amount of product selectively to the application member while leaving the shield substantially free of the product. The loading system has a dosage indicator for showing the user how much product is used for a particular application and a level indicator for showing the user how much product is left. Methods for applying product to hair or hair-like objects using an applicator is also provided.

93 Claims, 9 Drawing Sheets

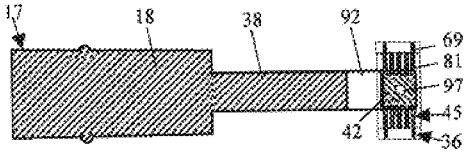
Fig. 4h
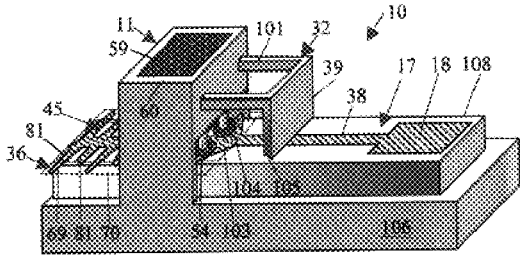
Fig. 5
Fig. 4i
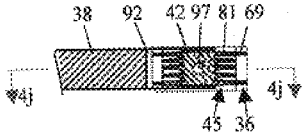
Fig. 4j
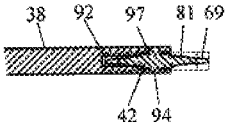
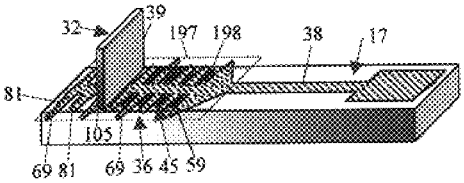
Fig. 5a

APPLICATOR AND METHOD FOR APPLYING FLUID OR PASTE PRODUCT TO TARGETED SURFACE

FIELD OF THE INVENTION

The invention relates to an applicator and method for applying fluid or paste product to targeted surface. By way of example, the invention can be used for applying fluid or paste product to hair or hair-like objects (e.g. eyelashes, eyebrows, leg hair, head hair, arm hair or mustache) for cosmetic, personal or medical care purpose.

BACKGROUND OF THE INVENTION

When a fluid or paste product such as mascara or other hair treatment product is applied to hair or hair-like objects such as eyelashes, eyebrows, hand hair, head hair, leg hair or mustache, there is a great risk of staining or smudging the skin with the product. Such risk is greater if the hair-like objects are short or the user wants to coat the complete length of the hair. When such staining or smudging happens it is usually necessary for the user to clean the smudged skin, especially if the product has a darker color or is toxic to the skin. Such cleaning, besides being time consuming, is a difficult and tedious task. If the skin right below the hair-like objects is stained it is usually impossible to clean the skin without touching the coated hair. This may cause the product on the hair to be transferred to the skin, thus worsening the cleaning work and requiring re-application of the product to the hair. In addition, the cleaning normally requires rubbing the skin with tissue or other porous materials, which may cause redness or itching of the skin.

U.S. Pat. No. 5,890,499 to Fuentes, U.S. Pat. No. 5,311,888 to Leigh, U.S. Pat. No. 5,178,170 to Kassai, U.S. Pat. No. 5,050,624 to Kobe, U.S. Pat. No. 5,016,658 to Green and U.S. Pat. No. 4,033,364 to Inzana and Terrett taught various eye make-up shields to cover the skin prior to applying mascara product to eyelashes with an applicator. Such shields require the user to hold it with one hand while the user applies mascara with other hands. This makes the application more complex. In addition, such shield is not able to prevent the skin directly below the hair-like objects from being stained.

Obviously, both consumers and manufacturers desire a convenient and easy method and solution to allow the application of liquid or paste to hair-like objects like eyelashes, eyebrows, head hair or mustache without smudging or staining the skin below or adjacent to the hair.

It is therefore an object of the invention to provide an applicator and method for consumers to apply fluid or paste product to hair or hair-like objects without smudging or contaminating the skin below or adjacent to the hair or hair-like objects.

It is a further object of the invention to provide a system for applying an amount of fluid or paste product to an applicator in a way so that the applicator has a significantly reduced chance to contaminate the skin or surface below or adjacent the hair or hair-like objects to be coated.

It is a still further object of the invention to provide an applicator and method for allowing a user to apply product to and comb the hair or hair-like objects simultaneously.

It is a still further object of the invention to provide an applicator having an indicator to indicate how much product is applied for a particular application and how much product remains in the applicator, thereby helping the consumers to avoid events that the applicator is out of product when it is mostly needed.

Still other objects will become apparent after reading the accompanying drawings and description. It should be understood that the invention could still be practiced without performing one or more of the objects set forth above.

SUMMARY OF THE INVENTION

Accordingly, the invention provides an applicator for applying fluid or paste product to hair or hair-like objects on skin or a surface. The applicator comprises a handle, an application member for holding an amount of product and applying the product to the objects, and a shield for covering at least part of the application member to prevent the surface from contacting the application member during the use of the applicator, thereby preventing the surface from being contaminated by the product. The shield has at least one opening configured to allow the hair or hair-like objects to reach the product on the application member, thereby causing the objects to be coated by the product. In one embodiment of the invention, the shield is movable between a first position, in which the shield covers the application member or a particular part of the application member, and a second position, in which the shield is away from the application member or cover a different part of the application member. In another embodiment of the invention, the shield is attached to or formed on the application member.

A product loading system is used to load an amount of product selectively to the application member while leaving the shield substantially free of the product. The loading system has a dosage indicator for showing the user how much product is used for a particular application and a level indicator for showing the user how much product is left and when the applicator needs to be replaced. In one embodiment of the invention, the product loading system is adapted to load the product to the application member when the shield is away from the application member and the shield is moved to cover the application member or part of the application member prior to use. This product loading system comprises a container for a supply of product having an inlet and a wiper mounted at the inlet. The handle enables the application member to be inserted into the container and withdrawn therefrom in such a way that excess product is wiped off said application member at the wiper. The inlet is configured to prevent the shield from entering the container. Alternately, this product loading system may comprise a first container for a supply of product, a second container having an inlet configured to prevent the shield from entering the second container for containing the application member, a pump for dispensing an amount of product from the first container via a passageway to the second container, and a distributor mounted at the inlet for distributing the amount of product to said application member and removing excess product.

In another embodiment of the invention, the product loading system is adapted to load the product to the application member when the application member is at least partially covered by the shield. The product loading system comprises a container for a supply of product, a pump for dispensing an amount of product from the container via a passageway towards the application member, and a distributor comprising at least one distributor each of which has a free edge configured to apply the product to the application member and to remove excess product. In one configuration, each distributor head is adapted to move according to its own predetermined path to apply the product to the application member, thereby enabling the distributor head to stay away from the shield. In another configuration, the application member is adapted to move against the free edge of the distribution head to cause the product to be distributed to the application member. The distributor may be mounted at an inlet of a second container for containing the application member and a chamber may be provided to confine the amount of product from the pump and to prevent the amount of product from reaching the shield. Alternately, this product loading system may comprise a container for containing a supply of product, a passageway for fluid communication between the container and application member, which application member contains capillary openings for drawing fluid from the container to the application member via the passageway by capillarity or capillary force, and a fluid keeper for preventing the product in the container from flowing out of the application member as a result of gravity.

Another aspect of the invention is a method for applying product to hair or hair-like objects using an applicator. The applicator comprises a handle, an application member connected to the handle for applying fluid or paste product to the hair or hair-like objects, and a shield adapted to cover at least part of the application member to prevent the skin or surface to which the hair or hair like objects are attached or adjacent from contacting the at least part of the application member covered by the shield, thereby reducing the risk of contaminating the surface with the product during the use of the applicator, and to allow the hair or hair-like objects to reach the product held by the at least part of the application member covered by the shield, thereby causing the hair or hair-like objects to be coated by the product. The method includes steps of holding the handle of the applicator, selecting the hair or hair-like objects to be treated, adjusting the handle position to ensure that the shield is between the surface to which the hair or hair like objects are attached or adjacent and the application member, moving the applicator toward the surface until the shield touches the surface or the base portion of the hair or hair-like objects reaches the product held by the at least part of said application member covered by the shield, moving said applicator in a way such as along the hair or hair-like objects from base to tip or along the surface from one area to another to transfer the product from the application member to the hair or hair-like objects. The shield can be configured to comb hair or hair-like objects thereby allowing the hair or hair-like objects, which tends to adhere to each other after being coated with the product, to be separated or combed during the step of moving the applicator in a way such as along the hair or hair-like objects from base to tip or along the surface from one area to another.

DESCRIPTION OF THE DRAWING

The accompanying drawing illustrates diagramatically non-limitative embodiment of the invention, as follows:

FIG. 4*h* is a sectional view of an alternate applicator for the system of FIG. 4;

FIG. 4*i* is a sectional view for the alternate applicator with the application member rotated 90 degrees;

FIG. 4*j* is a sectional view along line 4*j*—4*j* of FIG. 4*i;*

FIG. 5 is a perspective view of a product pump and distributor for dispensing fluid or paste product to an application member without contaminating the shield;

FIG. 5*a* shows a sectional view of the application member and shield after the application member is partially filled with the product;

FIGS. 11*a*–11*e* show the use of several exemplar applicators to apply mascara to hair or the like.

DETAILED DESCRIPTION OF THE PREFERRED EMBODIMENTS

Figure 1:
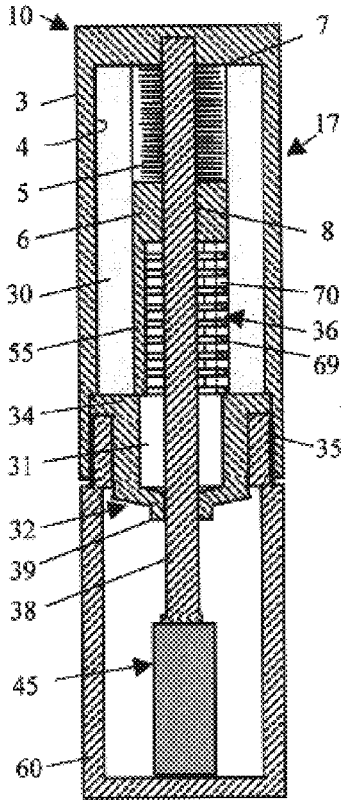
FIG. 1 is section view of an embodiment of an system, showing a shield in its non-working position.

Reference will now be made in detail to the present preferred embodiments of the invention, examples of which are illustrated in the accompanying drawings. Wherever possible, the same reference numbers are used in the drawings and the description to refer to the same or like parts.

System 10 of FIG. 1 comprises a container 60 for containing a supply of fluid or paste product and an applicator 17 removably attached to the container 60 by thread means 35. The applicator comprises a handle 3, an application member 45 connected to bottom 7 of the handle by a connector 38, and a shield 36 received in a chamber 4 formed in the handle. A product distributor 32 is mounted at the inlet of the container 60 for controlling the amount of fluid or paste product to be held by the application member 45. The product distributor has an upper wall 34 for preventing the shield from being pushed into distributor inlet 31 and a wiper 39 for removing excess fluid or paste product from the application member 45 when it is removed from the container 60.

Figure 1A:
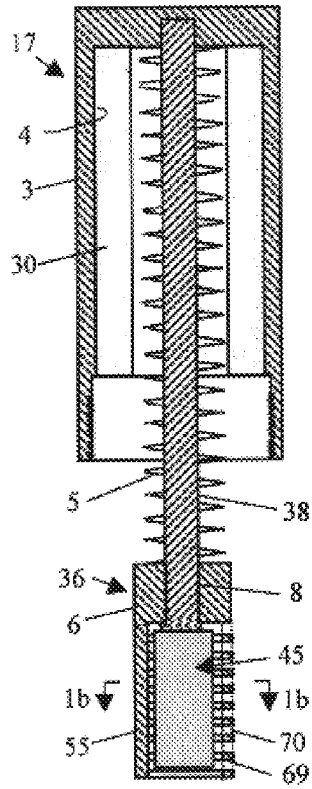
FIG. 1*a* is section view of the applicator for the system of FIG. 1, showing a shield in its working position.
Figure 1B:
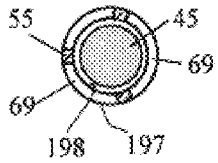
FIG. 1*b* is a sectional view along line 1*b*—1*b* of FIG. 1*a;*

The shield 36 comprises a base 6 having an opening 8 fitted slidably onto the connector 38, a plurality of curved thin members 69 connected to the base 6 via at least one support beam 55, and a plurality of openings 70 formed between the thin members. Shield 36 may comprise materials such as plastics, metals, elastomers and ceramics. The openings 70 are dimensioned to allow hair or hair-like objects to pass through but to prevent the surface to which the hair or hair-like objects are attached from passing and contacting the application member. The thin members 69 may be edge-taped or adopt other structures to better direct the hair or hair-like objects to the application member. The thin members together form an inner cylindrical surface 198 facing the application member and an outer cylindrical surface 197 adapted to contact the skin or surface to which the hair or hair-like objects are attached or adjacent. A spring 5 is positioned between the bottom 7 and the shield 36 for pushing the shield downward to cover the application member 45 after the application member is removed from the container 60 (FIGS. 1*a* and 1*b*). The opening 8 of the base 6 can be dimensioned to allow the shield to be able to rotate around the application member. The spring 5 can be removed and the shield 36 may be designed to move by its weight towards the application member 45 or be moved manually.

A cleaner 30 in chamber 4 has a central hole dimensioned to receive the shield 36 frictionally for cleaning the shield, especially for cleaning the outer surface 197 of the shield, when the shield is pushed into the chamber 4. The cleaner can be made of any porous materials such as paper, fabrics or foam. Shield 36 may be potentially contaminated by the product on the applicator member and the product that has been applied to the hair or hair-like objects. Since the outer surface 197 of the shield may contact the skin or surface during the application, it is important for the cleaner 30 to remove any product contamination on the outer surface 197. The cleaner 30 can be adapted to be user-replaceable in case that the cleaner becomes too dirty. To reduce the contamination of the shield by the product, the inner surface 198 of the shield may be positioned a predetermined distance away from the outer surface of the application member. It is preferred to keep the shield including the inner surface 198 free of product contamination in spite that the product not directly on the outer surface 197 has a less chance to smudge the skin or surface. To minimize the contamination of the shield by the product, materials with low affinity to fluid or paste product such as fluoropolymers (such as Teflon), liquid crystal polymers or silicone may be used as the material of construction or surface coating.

The application member 45, both in this exemplar embodiment and those to be described later, can be any structure that can hold an amount of fluid or paste product and apply the product to the surface of an object such as hair or hair-like object. Such examples include a brush formed by tufts of bristles or fibers, a comb with a plurality of tines, a porous structure like a foam, felt, sponge, sintered particles, flocking or fiber assembly, a cylinder with ribbed profile or ring-like discs or a flat surface, a spring, and a structure with roughened or smooth surface.

The shield 36, both in this exemplar embodiment and those to be described later, can adopt various configurations to achieve the objective of preventing the surface to which the hair or hair-like objects are attached or adjacent from being smudged or stained by the application member. Some of the various shield configurations will be shown in FIGS. 2 to 10. The shield can be configured to cover only part of the outer surface of application member 45. For example, a column of thin members 69 between two support beams 55 may be removed to expose part of the application member. The shield can be designed to be removable from the applicator 17 or washable to allow the user to remove and wash the shield if the shield becomes dirty. The openings 70 and thin members 69 of the shield can be dimensioned and shaped to comb the hair or hair-like objects during the application of the product. Different structure for wiper 39 may be used for different application member 45.

In FIG. 1, the application member is loaded with product when it is inserted it into the product in container 60 and later withdrawn therefrom to remove excess product at wiper 39 of the distributor 32. The application member can also be loaded with product by other product loading system such as those to be described in FIGS. 4, 9 and 10. For example, one of such other product loading systems comprises a container for containing a supply of the fluid or paste product in handle 3 and the product is delivered to the application member 45 -by an internal passageway formed in the connector 38 (not shown).

Figure 2:
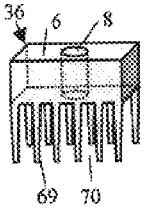
FIGS. 2, 2*a* and 2*b* are sectional views of alternative shields for shield of FIG. 1.

FIG. 2 shows an alternative to the shield 36 of FIG. 1. This alternate shield 36 comprises a plurality of thin members 69 in the shape of tines or teeth attached to base 6, a plurality of openings 70 between the thin members, and opening 8 formed on the base between the front and back rows of the thin members to receive connector 38. The application member 45 is received in the space between the front and back rows of the thin members. The thin members 69 and openings 70 of the shield can be dimensioned and shaped to function like the tines for a comb, thereby enabling the user to apply fluid or paste product to and to comb the hair or hair-like objects simultaneously.

Figure 2A:
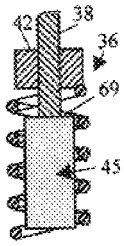
Figure 2B:
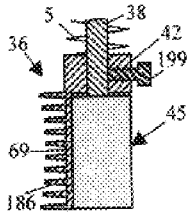

FIG. 2*a* shows a shield 36 that comprises a base 42 and a coil- or spiral-shaped thin member 69. The openings between two adjacent turns of the spiral-shaped thin member 69 allow the hair or hair-like objects to reach the application member 45 enclosed by the spiral-shaped thin member 69. The material and structure for the spiral-shaped thin member is so selected to minimize the tendency of the spiral-shaped thin member to bend towards the application member when the shield is pushed. It is optional to remove the spring 5, especially if the spiral-shaped thin member 69 is long enough to cover the connector 38 at its extended state. FIG. 2*b* shows a shield 36 that comprises an elongated thin member 69 with a plurality of comb tines 186 formed on it for combing the hair or hair-like objects. A locking member 199 is located on the base 6 for allow the user to locking the shield into any position. The shield 36 is pushed downward by spring 5 to cover a small part of the application member 45 after the applicator is removed from the container 60. The spring 5 may not be necessary and the user can manually pull the shield down from top portion of the connector 38. In this particular example, the shield functions more like a comb than a shield. It is, however, appreciated that more thin members may be added to the shield so that the shield can effectively prevent the contamination of smudging of the surface to which the hair or hair-like objects are attached or adjacent.

Figure 3:
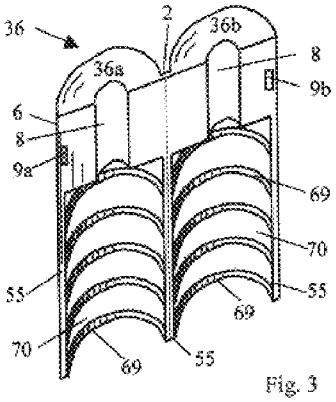
FIG. 3 is a sectional view of another alternative shield for the shield of FIG. 1.
Figure 3A:
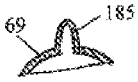
FIG. 3*a* is the sectional view of a modified thin member for the shield of FIGS. 1 and 3.

FIG. 3 shows another alternative to the shield of FIG. 1. This alternate shield 36 comprises a first half shield 36*a* and a second half shield 36*b* connected by a bendable thin strip 2. Each half shield has a plurality of thin members 69, a plurality of openings 70 formed between thin members and a half cylindrical opening 8 on base 6. The ends of each thin member are connected to support stems 55 extended downward from the base 6. The shield can be attached to connector 38 of the applicator 17 by closing the two half shields to form a cylindrical shield around the application member 45 and locking them in position by mechanism 9*a* and 9*b*. The user can remove the shield from the applicator 17 or move it upward to exposure part or all of the application member 45. A half shield 36*a* or 36*b* in which the half cylindrical opening 8 is adapted to form a snap fit with the connector 38 to keep the half shield on the application member can be used alone to replace the shield 36 when it is satisfactory to shield half of the application member 45. The thin members 69 and openings 70 of the shield can be dimensioned to effectively comb the hair or hair-like objects as the hair or hair-like objects penetrate the shield and become coated with the fluid or paste product on the application member 45. To further improve the combing by the thin members 69, a protrusion 185 (FIG. 3*a*) may be formed on each thin member of the shield 36 of FIGS. 1 and 3 so that a vertical row of protrusions for combing hair or hair-like objects is formed on the shield.

Figure 4:
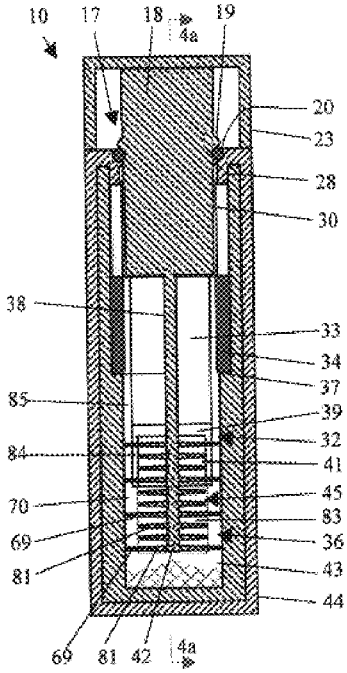
FIG. 4 is a sectional view of an applicator sealed in a container, showing a shield enclosing the application member.

FIG. 4 shows another alternate shield 36 for a comb-type applicator 17 in an alternate system 10. The comb-type applicator comprises handle 18, connector 38 and application member 45 having a plurality of tines 81 attached to applicator body 42 and a plurality of spaces 83 between the tines for holding fluid or paste product. The shield 36 comprises a plurality of thin members 69 connected directly to the top of at least some of the tines 81 and a plurality of openings 70 between the thin members. The thin members 69 and openings 70 on the left side of the shield 36 form a first half shield that prevents a skin or surface from contacting the fluid or paste product held by the tines 81 and openings 83 on the left side of the application member but allows hair or the like objects to penetrate to reach the product held by the application member. Likewise, the thin members 69 and openings 70 on the right side of the shield 36 form a second half shield that prevents a skin or surface from contacting the product held by the application member but allows hair or the like objects to penetrate to reach product held by the application member. The first and second half shields allow the user to apply the product to hair or hair-like objects and to comb them simultaneously with the comb-type application member without worrying about smudging or staining the skin below or adjacent to the hair objects. The surface of the tines 81 of the application member 45 may be treated with plasma, corona discharge or other surface treating methods to achieve higher surface energy, roughened, or textured to improve their ability to hold the product. The thin members 69 may be made smooth, or made of or coated with low-adhesion materials like fluorinated polymers to reduce the adhesion of the product to their surface.

Figure 4A:
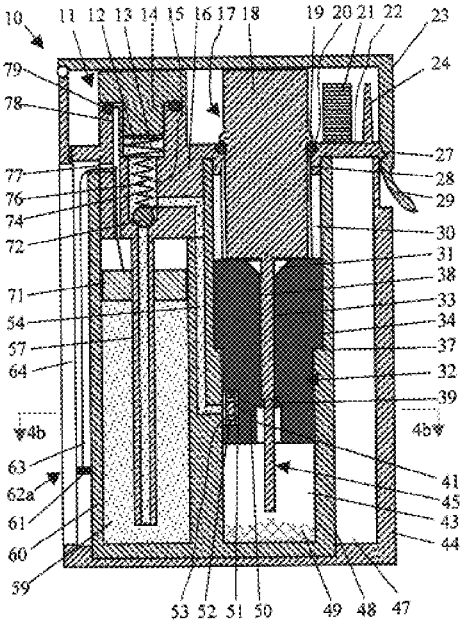
FIG. 4*a* is a sectional view of the system for the applicator along line 4*a*—4*a* of FIG. 4.
Figure 4C:
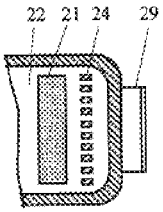
FIG. 4*c* is a sectional view for showing the cross-section of parts 21 and 24 of FIG. 4*a;*
Figure 4B:
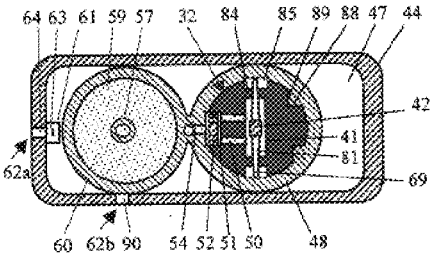
FIG. 4*b* is a sectional view along line 4*b*—4*b* of FIG. 4*a;*

The alternate system 10 further comprises a product loading system having a pump 11 for dispensing a measured amount of fluid or paste product 59 from container 60 to container 43 via fluid passageway 54 and a product distributor 32 in container 43 for distributing the product to the tines 81 and spaces 83 of the application member 45 and removing excess product (FIGS. 4, 4*a* and 4*b*). Both containers 60 and 43 are housed in chamber 47 of housing body 44. The fluid or paste product 59 in this and other exemplar embodiments described in FIGS. 1 to 11 may be applied to the hair or hair-like objects for cosmetic, personal care, medical care or any other purposes. For examples, the product 59 may be used to for thickening, concealing, coloring or dying, conditioning, softening, shining, adhering, removing or fixing hair or hair-like objects such as eyelashes, head or scalp hair, chest hair, leg hair, arm hair, eyebrow, mustache, beard, or fibers.

The product pump comprises a lower chamber 74 having an inlet 57 for the product 59 in the container 60 to enter and an outlet connected to fluid passageway 54 and a upper chamber 13 formed in pump body 16 for receiving a piston 14. A disc or ball 72 is placed in the lower chamber to close the inlet 57 when the piston 14 is pushed downward and to open the inlet when the piston is pushed upward by a spring 12. An optional spring 76 is applied to the ball 72, which may not sink fast enough in viscous or pasty product, to ensure fast and proper closing of the inlet when the piston 14 is pushed downward. Spring 76 is so designed that the force it applies to the ball 72 is lower the vacuum force created when the piston 14 is pushed upward by spring 12 to ensure proper opening of the inlet. The piston 14 is designed to be pushed downward by a lid 23 when the user closes the lid 23. (Note: The piston 14 may also be designed to be pushed downward by the user directly rather than through the lid 23.) A seal gasket 79 is placed on pump body 16 to reduce potential moisture loss in the product 59. A lock mechanism 27 is formed on the lid 23 and house partition 22 to maintain the lid, thus the piston, in the "down" position when the system is not in use. A handle 29 is formed on the lid to allow the user to open the lid, thus allowing the spring push the piston upward, by simply pulling the handle away from body 44 of the system.

Pump 11 may comprise a disc 52 having a plurality of holes 53 to allow the product from the chamber 74 to pass through and a non-porous center portion to block the passageway 54 to prevent the dispensed product from flowing back when vacuum is generated in chamber 74. A restricted channel 78 is formed in pump body 16 to allow air to enter container 60 as the product 59 is dispensed. The pump may comprise a product level indicator 62*a* to show the user the amount of the fluid or pasty product in the first container 60. Level indicator 62*a* comprises piston 71, a visual indicator 61, a flexible connector 63 for connecting the visual indicator to the piston disc through a restricted opening 77 and the lower part of restricted venting channel 78, and a display window 64 for the user to see the position of the visual indicator, which indicates how much of the product 59 remains in the container 60. The downward movement of piston 71 causes the visual indicator 61 to move upward as the product 59 is dispensed. The piston 71 also prevents the product from sticking to the wall of container 60 and inlet 59 due to the viscous and pasty nature of the product as the product 59 is dispensed, thus reducing wastefulness and false indication of the amount of product remaining in the container 60. The pump 11 may have an additional level indicator 62*b* (FIG. 4*b*), which comprises a second display window 90 to show the position of the piston disc, thus the level of the product 59 in the container 60. With level indicator 62*b*, the wall of the container 60 needs to be transparent or translucent to allow the user to view the piston disc 71.

The product distributor 32 comprises a sloped entrance 31 for facilitating the insertion of the application member 45 through a channel 33 into container 43, an upper body 34 supported on a base 37, a chamber 51 for housing the disc 52, a chamber 41 in which the upper section of the application member 45 is located, a plurality of channels 50 for allowing the product to be delivered from chamber 51 to chamber 41, and a distribution head 39 having a free edge for spreading the product delivered to chamber 41 uniformly into the spaces 83 between tines 81 and removing excess product. Four confining walls 84 of the chamber 41 (FIGS. 4 and 4*b*), two on each side of the application member 45, press against the thin members 69 of the shield 36 or the top part of tines 81 of the application member 45, thereby preventing the product from being spread to the thin members 69 of the shield. Two vertical chambers 85 are formed in the distributor 32 to reduce potential contamination of the shield 36 with product 59 during the insertion or removal of the applicator 17 into container 43. The distributor 32 is prevented from rotation by a protrusion 88 formed on the inner wall of the container 48 and a recess 89 on the distributor. Porous material 49 is placed at the bottom of chamber 43 to absorb or retain the excess product coming from the distribution chamber 41, thus preventing the excess product from contaminating the shield 36. Other structures (not shown) such as partition walls may be formed at the bottom of the chamber 43 close to the surface of the shield and application member to prevent the excess product from reaching the shield. The porous material may contain certain solvent used in the product 59 to moisture the chamber 43 and prevent the product on the application member from drying out.

A cleaner 30 consists of a cylindrical porous material located between wall 28 formed on partition plate 22 and the distributor 32 for cleaning the shield 36 if it becomes contaminated by the product 59 or other contaminants. To increase the life of the cleaner 30, the number of thin members 69 on the shield may be reduced. However, it is appreciated that with too few thin members 69, the openings 70 of shield 36 may become too large to prevent the application member 45 from contaminating the skin or surface. A plurality of scraping members 24 such as tines or wires are attached to the partition plate 22 to allow the user to remove residual or partially hardened product between the tines 81 on the application member 45 by "combing" the row of thin tines or wires 24 with the application member (FIGS. 4*a* and 4*c*). A stack of porous sheet material like paper or fabric 21 is also attached to the partition plate 22 to allow the user to clean the shield 36 or to clean any other part of the applicator 17.

The product pump 11 can be replaced with other pump such as a piston pump, a flexible pouch that can be pressed to deliver the fluid or paste therein or any other metered delivery system, which together with this product pump 11 are collectively referred to as pump. The container 60 can be replaced with a flexible pouch so that venting channel 78 in the upper pump body 16 can be removed. The product distributor 32 can adopt other structures or shapes such as those to be shown in FIGS. 5–10. This comb-type application member can adopt other structures or shapes such as those to be shown in FIGS. 5–9. The shield 36 for this particular comb-type application member may also adopt other structures or shapes such as those in FIGS. 1, 3, 5, 6, 7 or 8.

FIGS. 4*h–j* show an alternate applicator 17 where the application member 45 and shield 36 are received in a recess 92 formed at the bottom of connector 38. A protrusion 94 is formed on each side of the applicator body 42 and is inserted into an opening 97 formed on each side wall of the recess 92. The application member is in the position shown in FIG. 4*h* when the applicator is inserted or removed from the container 43 to ensure proper distribution of the product. The user may rotate the application member 45 by rotating the product-free shield 36 around the protrusion 94 to achieve any convenient angle to apply the product to hair or like objects. For example, when the application member is in position as shown in FIG. 4*i*, the applicator may be used conveniently for applying the product to eyebrow or mustache. The shape and dimension of the recess is designed to ensure reasonable stability after the angle of the application member is adjusted.

FIGS. 5 and 5*a* show an alternate product loading system comprising product pump 11 and distributor 32 for applying fluid or paste product 59 to a comb-type application member 45 without contaminating shield 36. The product pump 11 is supported on a base 106 and is adapted to dispense product droplets 104 from container 60 on to the head portion 103 of the application member supported on a movable plate 108. The product distributor 32 has a distribution head 39 with a taped free edge 105 for spreading the product droplets 104 into the spaces between tines 81 when the applicator is pulled towards the left (FIG. 5*a*). The pump 11 may dispense additional droplets during the process of pulling the applicator. The movable plate 108 and the distribution head 39 may have similar width as the application member to reduce the possible contamination of the shield 36 by the product 59. The shield 36 comprises thin members 69 connected to certain tines 81 of the application member 45 and openings 70 formed between the thin members (FIGS. 5 and 5*a*). The outer ends of the thin members 69 defmes the outer surface 197 of the shield adapted to face the skin during the application of product 59 to hair and the inner ends of the thin members defines the inner surface 198 of the shield (FIG. 5*a*).

Figure 5B:
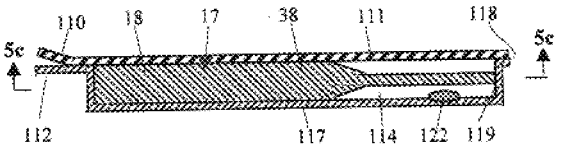
FIG. 5*b* is a sectional view of the applicator of FIG. 5*a* sealed in a container.

After loading the application member 45 with product 59, one may apply the product to hair or immediately or seal the applicator 17 in a container for later use. When the applicator is to be sealed for later use, it is critical to prevent the product 59 in the application member 45 from contaminating shield 36 and the container during storage and handling. FIGS. 5*b* and 5*c* shows two identical applicators 17 sealed in two containers 117 connected by a perforated connection region 120 for easy separation of the two containers. The container 117 is dimensioned to fit handle 18 and application member 45 and to restrict the movement of the applicator, thereby reducing the opportunity of transferring the product in the application member 45 to the container or the shield 36. The container 117 has a side wall 119, a peripheral flange 118 formed around the side wall 119 and an extended flange segment 112. A cover 111 such as a flexible barrier film is sealed to the flange 118 to prevent the product 59 in the application member from drying. The cover has a grip 110 above the extended flange segment 112 and is not sealed to the extended flange segment for allowing the user to grip and peel off the cover from the container 117 prior to use. The application member is separated from the bottom wall and film 111 of the container 117 by space 114 to prevent the transfer the product 59 to the container and cover. The container 117 may be thermally formed and the cover may be sealed to the flange 118 by heat.

Figure 5D:
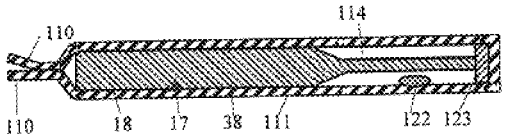
FIG. 5*d* is a sectional view of the applicator of FIG. 5*a* sealed in an alternate container.
Figure 5C:
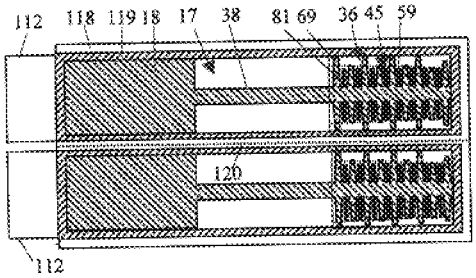
FIG. 5*c* is a sectional view along line 5*c*—5*c* of FIG. 5*b;*

FIG. 5*d* shows an alternate container for sealing the applicator 17 for later use. The applicator is wrapped by the flexible barrier film 111 tightly to prevent its movement therein, thereby minimizing the transfer of the product 59 from the application member to the film or to the shield 36. The film is sealed near the four sides of the applicator to prevent the drying of the product. A space 114 is formed between the upper and lower film 111 to prevent the transfer of the product 59 from the application member to the film and the shield. A stretcher 123 may be removably attached to the free (right) end of the application member 45 or formed as part of the application member to increase the distance between the application member and the film, especially near the right end of the application member. A small segment 110 of the film is not sealed to assist the user to peel the film apart prior to use.

A small pouch 122 is located in the space 114 as shown in FIGS. 5*b* and 5*d*. The materials used for the cover (or film) 111 and the container 117 are preferred to have low permeability to moisture and solvent in the product 59. The pouch can contain the water or/and solvent used in the product 59 loaded in the application member 45 for the purpose of compensating the potential loss of water or solvent through the film 111 or container 117. If the product 59 in the applicator member 45 is moisture sensitive, the pouch may contain water-absorbing material such as calcium oxide or molecular sieve to remove the moisture that may permeate through the film 111 or container 117. Such water absorbing material may also be coated or impregnated on the inner surface of the film 111 or container 117. An example of such moisture-sensitive products 59 is a product comprising components such as a polysiloxane that polymerizes or cross-links upon exposure to moisture. Such polymerizable product 59 may be applied to hair or hair-like objects such as eyelash, hair on the scalp or eyebrow when it is desired to have a permanent or semi-permanent coating on the hair surface. It is appreciated that with minor modifications, the containers described in FIGS. 5*b–d* can be used to contain the applicators of FIGS. 1, 4 and 6–10 after the applicators are loaded with the fluid or paste product.

Figure 6:
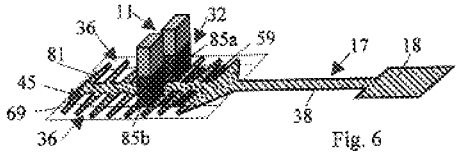
FIG. 6 is a schematic view of an alternate mechanism to deliver and distribute the product to an application member without contaminating the shield.
Figure 6A:
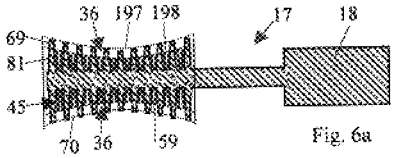
FIG. 6*a* is a sectional view of an application member loaded with product through the alternate way of FIG. 6 and a product-free shield.

FIG. 6 shows an alternate product loading system comprising a pump 11 and a product distributor 32 (shown partially) for loading the fluid or paste product 59 to a comb-type application member 45 without contaminating shield 36. A thin member 69 of the shield 36 is connected to or formed on the top of each of the tines 81 of the application member 45. This shield can have more thin members per inch than the shield in FIGS. 4 and 5, and as a result may separate hair or hair-like objects more efficiently. The distributor 32 comprises two separate distribution heads 85*a* and 85*b* for receiving the product from the product pump 11, each capable of moving according to its own path. Each distribution head may comprise a porous member for absorbing the product 59 from the pump and transferring the product to the application member as it moves left along the application member. Alternately, it may comprise a mini-container for receiving the product from the product pump 11 and a blade to transfer the product in the mini-container to the application member as the head moves left. Such product distributor allows the loading of product to application members of irregular shapes. In the application member 45 of FIG. 6, the distribution heads 85*a* and 85*b* moves inside the curved dotted lines to ensure that the application will not reach the shield 36, thereby making the shield product-free. FIG. 6*a* shows an application member with the shield 36 having a curved edge to match the shape of a human eyelid. With the product distributor of FIG. 6, each of the distribution head 85*b* and 85*a* can move along the application member following the curvature of the shield to apply the product to the application member without contaminating shield 36. The shield 36 comprises thin members 69 connected to the tines 81 of the application member 45 and openings 70 formed between the thin members (FIG. 6*a*). The outer ends of the thin members 69 defines the outer surface 197 of the shield adapted to face the skin during the application of product 59 to hair and the inner ends of the thin members defines the inner surface 198 of the shield (FIG. 6*a*).

Figure 7:
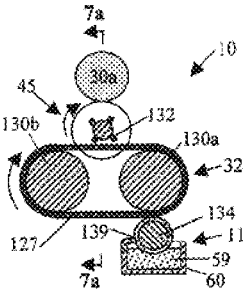
FIG. 7 is a sectional view of another alternate mechanism to deliver and distribute the product to an application member without contaminating the shield.
Figure 7B:
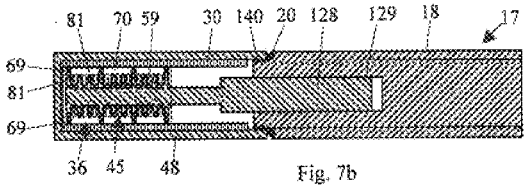
FIG. 7*b* is a sectional view of the applicator of FIG. 7*a* loaded with fluid or paste product and a cap for preventing the product from drying out.
Figure 7A:
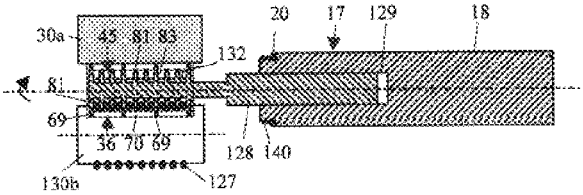
FIG. 7*a* is a sectional view along line 7*a*—7*a* of FIG. 7.

FIGS. 7 and 7*a* show another alternate product loading system comprising product pump 11 and distributor 32 for loading the product 59 to a cylinder-shaped application member 45 without contaminating the shield 36. The cylinder-shaped application member 45 is connected to a cylindrical roller 128 which is inserted into a cylindrical opening 129 formed in handle 18 so that the application member may rotate during the application of product to hair or hair-like objects. The application member comprises a plurality of disc-shaped tines 81 and groves 83 formed between adjacent tines. The cylindrical shield 36 encloses the application member and comprises a plurality of thin members 69 and the openings 70 between the thin members. The pump 11 has a transfer roller 134 adapted to rotate in container 60 and a blade 139 for controlling the amount of product on the transfer roller. The distributor 32 comprises a plurality of loops 127 mounted between rollers 130*a* and 130*b* and spaced a predetermined distance apart so that each loop may transfer the product to a corresponding grove 83 between two adjacent ring-shaped tines 81. The fluid or paste product 59 is transferred from container 60 to transfer roller 134, then to the plurality of loops 127, and finally to the grooves 83 and tines 81 of the application member as a result of the rotation of transfer roller 134, rollers 130*a* and 130*b* and the application member. Four thin protrusions 132 are formed at the bottom of each groove to assist the transfer of the product from the loop to the groove. A cleaner roller 30*a* is contact with the thin members 69 of the shield 36 to clean any potential contamination of the thin member 69 by product 59.

After the application member is loaded with the product 59, it may immediately be used to apply the product to hair or hair-like objects by a user or it may be sealed in a container 48 via thread means 140 for later use. A porous cylinder 30 is located in container 48 for cleaning any potential contamination on the thin members 69 of the shield 36 by product 59 as the user inserts or removes the applicator 17 into or from the container. Part of the porous cylinder 30 can be impregnated with water or solvents to keep the product 59 on the application member moisturized during storage. If the product 59 is water sensitive, the porous cylinder can be impregnated with some water absorber like calcium oxide to absorb any water that enters the container.

Figure 8:
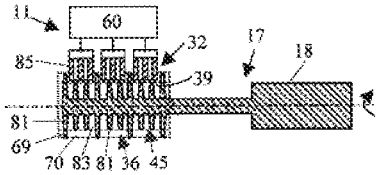
FIG. 8 is a sectional view of another alternate mechanism to deliver and distribute the product to an application member without contaminating the shield.

FIG. 8 shows another alternate product loading system comprising product pump 11 and distributor 32 for applying the product 59 to the cylinder-shaped application member 45 without contaminating the shield 36. The distributor 32 comprises a plurality of distribution heads 85, one for each opening 70 of the shield 36. Each distribution head 85 can be a mini-container for receiving the product 59 from container 60 delivered by pump 11. The wiper or a blade 39 at each distributor head loads the product to the disc-shaped tines 81 and grooves 83 in the corresponding opening 70 as the cylinder-shaped application member rotates. Alternatively, the distribution head may comprise porous member for receiving the product 59 from container 60 delivered by pump 11 and loading the product to the disc-shaped tines 81 and grooves 83 in the corresponding opening 70 as the cylinder-shaped application member rotates.

Figure 9:
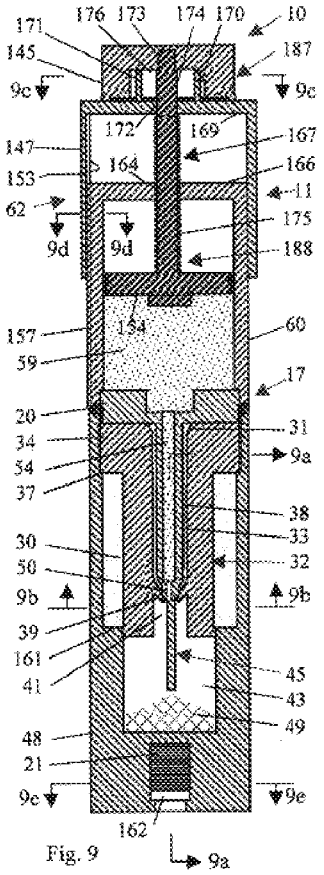
FIG. 9 is a sectional view of another alternate mechanism to deliver and distribute the product to an application member without contaminating the shield.
Figure 9D:
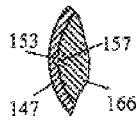
FIGS. 9*a* to 9*e* are sectional views along lines 9*a*—9*a* to 9*e*—9*e* of FIG. 9.
Figure 9B:
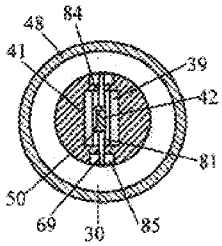
Figure 9C:
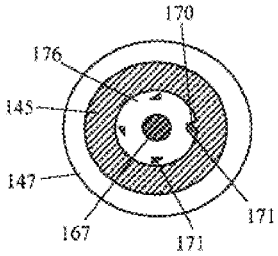
Figure 9A:
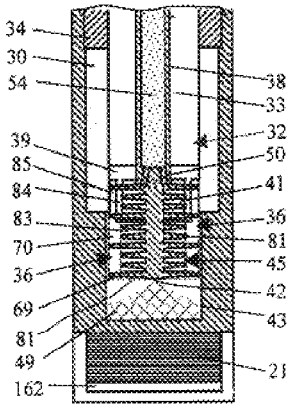
Figure 9E:
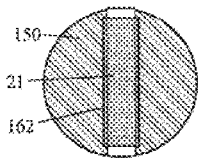

FIGS. 9 and 9*a–i* show another alternate product loading system comprising product pump 11 and distributor 32 for loading the product 59 to a comb-shaped application member 45 substantially without contaminating the shield 36. Both the shield and application member are similar to their counterparts in FIG. 4. The application member is connected to container 60 via elongated connector 38 with internal channel 54 and outlets 50 for the passage of the product 59 from the container 60 to the distributor 32. The distributor 32, similar to that in FIG. 4, is housed in the chamber 43 of container 48 for loading the product dispensed into the distribution chamber 41 to the application member 45 uniformly but without loading the product to the shield 36. The cleaner 30 consists of a porous cylinder located in the container for cleaning shield 36 when the user inserting or removing the applicator 17 from the container 48. A chamber 162 is formed at the bottom 150 of container 48 for containing a supply of cleaning materials such as a stack of tissue sheets 21 for providing the user an option for manually cleaning shield 36 or other parts of the system (FIGS. 9, 9*a* and 9*e*). Comb cleaner 24 can be formed at the bottom 150 for removing partially hardened product from the comb-type application member 45.

The pump 11 comprises a piston mechanism 188 for delivering the product 59 in container 60 to distributor 32 via channel 54 and outlets 50, an one-way driving mechanism 187 for controlling the piston mechanism, and a product indicator 62 having a product dosage indicator 146 for indicating to the user the amount of product delivered for a particular application and a product level indicator 191 for showing the user the amount of product remaining in container 60 or the life of the applicator. The piston mechanism comprises a piston 154, a shaft 167 having a threaded portion 175 connected to piston 154 and an unthreaded portion 174 connected to the one-way driving mechanism 187, and a threaded opening 164 on the top wall 166 for causing the piston to move downward when the shaft is turned by the driving mechanism. The one-way driving mechanism comprises a knob 145 having a chamber 176 and a hole 173 into which the top end of the unthreaded portion 174 of shaft 167 is inserted and locked in position, a plurality of pins 171 formed on the top wall 169 of a sleeve 147, and a protrusion 170 formed near the bottom of chamber 176 and shaped to cooperate with pins 171 to prevent the knob 145 from be turned anti-clockwise (FIGS. 9 and 9*c*).

The dose indicator comprises a plurality of graduated marks 146*a* on the top surface of the sleeve, a pointing mark 146*b* on the knob 145, and an anti-rotation mechanism comprising an elongated vertical groove 153 formed on the inside wall of the sleeve 147 and an elongated vertical protrusion 157 formed on the container 160 (FIGS. 9, 9*d* and 9*i*) for preventing the sleeve from being turned. Each of the graduated marks 146*a* may correspond to one or more pins 171 formed on the top wall 169 of the sleeve (FIGS. 9*c* and 9*i*). To deliver one dose of the product 59, one may turn the knob clockwise to the next mark 146*a*. The amount of product in one dose, which may be shown on the sleeve, is determined by the threads on the threaded portion 175 of the shaft 167, the number of graduated marks 146*a* per complete turn, the cross-section area of the container 60, and other factors. The user may choose to dispense more than one dose for an application. The level indicator 191 comprises graduated marks 192 showing the volume (in cc's) of the product remaining in the container 60, the bottom edge 193 of the sleeve as the pointing mark, and threaded portion 175 that has a larger diameter than the opening 172 formed on the top wall 169 of the sleeve to prevent the sleeve from being pushed down without turning the knob (FIGS. 9 and 9*i*). When the user turns the knob clockwise, the shaft 167 will move downward due to the engagement between the threaded portion 175 and the threaded opening on the top wall 166 of the container 60, thus causing the knob to push the sleeve downward.

Figure 9J:
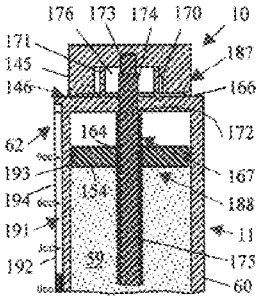
FIG. 9*j* is a section view of an alternate for the product pump of FIG. 9.
Figure 9I:
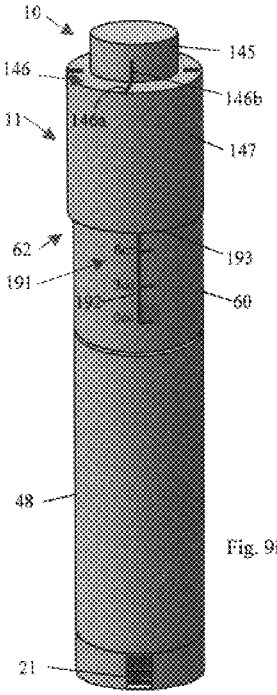
FIG. 9*i* is a perspective view of the system of FIG. 9 showing the product indicator.

FIG. 9*j* shows a modified version for the pump 11 of FIG. 9. This modified pump 11 differs from the pump of FIG. 9 in that the disc 154 is driven downward by the engagement of the threaded opening 164 formed at the center of the disc with threaded portion 175 of the shaft 167. It also differs in that the knob 145 rests directly on the upper wall 166 of the container 60 and there is no sleeve 147. As a result, the plurality of graduated marks 146*a* of the dose indicator is formed on the surface of upper wall 166 of the container 60. The graduated marks 192 of the level indicator 191 are located on a translucent or transparent strip window 194 on the wall between the top and bottom ends of the container 60 to show the colored edge 193 of the disc 154, which acts as the pointing mark for the level indicator. Opening 172, which is smaller in diameter than the threaded portion 175 of the shaft 167, is formed on the top wall 166 of the container 60 to prevent the threaded portion 175 from being pulled out of the container 60 by the turning of the knob 145. The turning of the knob clockwise by a user causes shaft 167 to turn, which causes disc 154 to move downward due to the engagement between the threaded portion 175 and the threaded opening 164 on disc 154.

It is appreciated that the system described FIGS. 9–9*j* can also be used for other applications where the shield 36, distributor 32 and cleaner 30 are not needed. For examples, when the application member 45 is a brush having a plurality of tufts for brushing teeth and the product is a toothpaste, the system can be used to apply a measured amount of toothpaste to teeth. When the application member is an orifice, the system can be used to dispense a known amount of medical product to skin. In both examples, the system allows the user to know exactly how much product is applied for a particular usage and when the product will run out and the user needs to purchase a replacement system.

Figure 10:
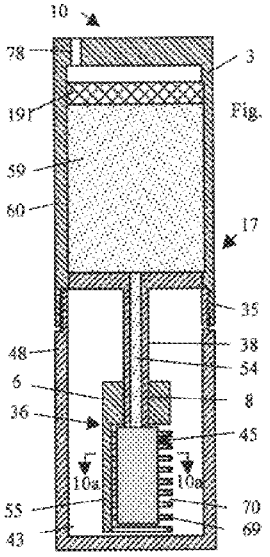
FIG. 10 is a section view of another alternate to the system of FIG. 1.
Figure 10A:
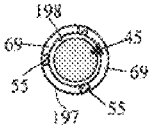
FIG. 10*a* is a sectional view along line 10*a*—10*a* of FIG. 10.

FIG. 10 shows another alternative system 10 comprising applicator 17 and a seal container 48 removably attached to the applicator via thread means 35. The applicator 17 comprises a handle 3, a cylinder-shaped application member 45 having numerous capillary openings, a cylindrical shield 36 for covering the application member thus preventing the application member from contacting the surface such as skin to which the hair or hair-like objects is attached or adjacent, and a product loading system. The product loading system comprises a product container 60 in the handle for containing a supply of the product 59, an internal channel 54 in connector 38 for fluid communication between the product container and application member, and a fluid keeper 191 for preventing the product 59 in container 60 from flowing out of the application member via channel 54 by gravity. The product loading system allows the product in container 60 to flow via internal channel 54 to the application member as a result of the capillary or capillary force of the numerous capillary openings and to load or replenish the application member as the product is applied to hair or hair-like objects. The application member can be a shaped porous material such as foam, felt, flocking or sintered material, a molded or extruded plastic part with capillary openings (such as openings of about 0.1 to 1 mm in size) in communication with the channel 54, or any combinations of these. A restricted opening 78 is formed on the top wall of the container to let air into the container when the product is used to replenish the application member. The restricted opening is restricted enough to minimize the loss of vapor through it.

Similar to the shield of FIGS. 1–3, the shield 36 here comprises a plurality of thin members 69 connected to base 6 via stems 55 and spaced apart by openings 70. The shield can be shaped to match the contour of the surface or skin to which the hair or like objects are attached. The thin members 69 and openings 70 can be dimensioned or structured to comb the hair or like objects when the user is applying the product to the hair. A plurality of protrusions similar to that in FIG. 3*a* may be formed on predetermined thin members to form a comb for combing the hair or like objects when the user is applying the product to the hair. The shield can be adapted to be removable from the application member by the user for cleaning or washing the shield.

The fluid keeper is a porous material in the container 60 that exerts sufficient capillary force against gravity to prevent the product in container 60 from freely flowing out of the application member, but does not exert too much capillary force to prevent the application member 45 from replenishing itself with the product. The fluid keeper can be other mechanisms such as a vacuum mechanism for keeping the product 59 in the container under a slight vacuum, e.g. 1 to 8 inches of water, to prevent the product in the container from freely flowing out of the application member. Such vacuum mechanism can be a spring-bag assembly with the spring pushing the opposing sides of the bag apart to produce a vacuum in the bag, which contains the product 59 in the container 60. The container 60 can be formed next to or within the application member to reduce or avoid the need for a fluid keeper. A wiper (not shown) can be used to be reduced the amount of product 59 on the application member prior to the application. A product pump and distributor such as those shown in FIGS. 4, 9 and 10 can be used to dispense the product 59 and distribute the dispensed product onto the application member 45.

FIGS. 11*a*–11*e* show the application of the product 59 to hair or hair-like objects such as eyelash, eyebrow, mustache, beard, scalp or head hair, hand hair, leg hair, chest hair, synthetic hair or fibers with several of the exemplar applicators containing shield 36 for cosmetics, medical, personal care or other purposes. To use applicator 17 of FIG. 1*a*, one holds the handle 3 (FIG. 1*a*) and moves the application member 45 covered by shield 36 towards the hair or hair-like objects 9 on surface 82 to be coated. The hair or hair-like objects pass through the openings 70 between thin members 69 and reaches the fluid or paste product on or in the application member. The applicator may be moved close or away from the surface 82 depending on the desired length of the hair or hair-like objects to be coated. The application member is prevented from contacting the surface 82, thus from contaminating or smudging the surface, by the thin members 69 of shield 36. By moving the application member and shield along the hair or hair-like objects 9 or surface 82, one causes the hair or hair-like objects to be coated with the fluid or paste product. At the same time, the hair or hair-like objects are separated or combed by the thin member if the shield is adapted to function also as a comb.

Figure 11A:
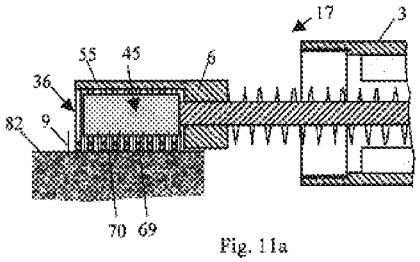
Figure 11B:
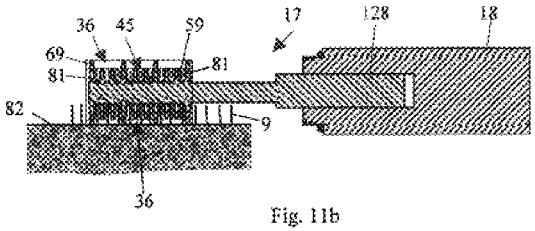
Figure 11C:
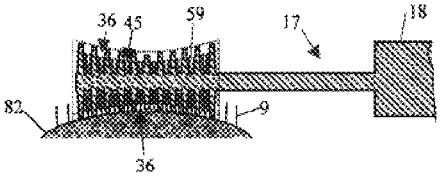

FIG. 11*b* shows the use of the cylinder-shaped applicator 17 of FIG. 7 to apply the product 59 on application member 45, which is enclosed by shield 36 to prevent the application member from contacting the surface 82, to the hair or the like objects. The application procedure is similar to that described in FIG. 11*a* except that the application member 36 and the surrounding shield 36 tend to rotate relative to handle 18 as the shield is moved surface 82. FIG. 11*c* shows the use of the applicator 17 of FIG. 6*a* to apply the product 59 on applicator 45, which is partially enclosed by shield 36 to prevent the application member from contacting the surface 82, to the hair or the like objects. The shield 36 of the applicator 17 has a curvature matching the contour of the surface 82 to improve the accessibility of the hair or hair-like objects to the product on the application member 45. The application procedure is similar to that described in FIG. 11*a*.

Figure 11D:
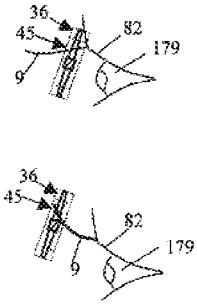
Figure 11E:
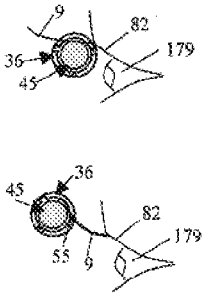

FIG. 11*d* shows the use of applicator 17, such as that in FIG. 4, 5 or 9, to apply the product on a comb-type application member 45 partially enclosed by shield 36 to prevent it from contacting skin 82 to eyelashes 9. To apply the product, one moves the front of the shield 36 towards the eyelashes until the eyelashes penetrate the shield 36 and reaches the product on or in the application member 45 (top drawing of FIG. 11*d*). The applicator may be moved close to skin 82 or tilted properly to ensure that most of the length of the lashes can be coated by the product. The application member is prevented from contacting the skin, thus from contaminating or smudging the skin, by shield 36. By then moving the application member and shield upward and away from the skin 82, one coats the eyelashes with the product (the lower drawing of FIG. 11*d*). At the same time, the hair or hair-like objects are separated or combed by the thin members of the shield 36 or by the tines of the application member 45. FIG. 11*e* shows the use of applicator 17, such as that in FIG. 7 or 8, to apply the product on a cylinder-type application member 45 to eyelashes 9. The application member is enclosed by cylindrical shield 36 to prevent the application member from contacting skin 82. The application procedure according to FIG. 11*e* is similar to that described in FIG. 11*d*. The eyelashes can be curled by pushing eyelashes upward with support stem 55.

The scope of the invention is obviously not restricted to the various embodiments described by way of examples and depicted in the drawings, there being numerous changes, modifications, additions, and applications thereof imaginable within the purview of the claims.

What is claimed is:

1. An applicator for applying fluid or paste product to hair or hair-like objects comprising:

a handle;

an application member connected to said handle for holding an amount of fluid or paste product and applying the product to hair or hair-like objects; and a shield for covering at least part of said application member, said shield comprising a first surface adapted to face the surface to which the hair or hair-like objects are attached or adjacent during the use of said applicator, a second surface opposing said first surface adapted to face said application member, and at least one opening dimensioned or shaped to allow hair or hair-like objects to reach the fluid or paste product held by said application member, thereby causing the hair or hair-like objects to be coated by the product, and to prevent the surface from contacting said application member through said at least one opening, thereby reducing the risk of contamination or smudging of the surface by the product on said application member.

2. An applicator as defined in claim 1 wherein said shield is adapted to be movable relative to said handle.

3. An applicator as defined in claim 2 further comprising a locking member for a user to fix the position of said shield.

4. An applicator as defined in claim 1 wherein said shield is adapted to be removably mounted to said applicator for covering at least part of said application member.

5. An applicator as defined in claim 1 wherein at least one of said shield and said application member is adapted to be rotationally movable relative to said handle.

6. An applicator as defined in claim 1 wherein said shield is fixedly connected to said application member.

7. An applicator as defined in claim 1 wherein said shield further comprises a plurality of thin members for forming said at least one opening.

8. An applicator as defined in claim 7 wherein said plurality of thin members and said at least one opening of said shield are configured to separate or comb hair or hair-like objects.

9. An applicator as defined in claim 1 further comprising an amount of paste or fluid product on said application member and a container for containing at least part of said applicator to prevent the product on said application member from hardening.

10. An applicator as defined in claim 9 wherein said container comprises a chamber for containing said applicator and a barrier film for sealing said chamber, said chamber having a predetermined space between said product on said application member and the interior surface of said chamber for minimizing the contamination of said container by said product.

11. An applicator as defined in claim 9 wherein said container comprises a flexible barrier film for forming a chamber to enclose at least said application member, said chamber having a predetermined space between said product on said applicator member and the interior surface of said chamber for minimizing the contamination of said container by said product.

12. An applicator as defined in claim 9 wherein said product is a polymerizable product for forming a permanent or semi-permanent coating on the hair surface.

13. An applicator as defined in claim 9 wherein said container comprises an amount of material for preventing the product on said application member from hardening.

14. A method of applying paste or fluid product to hair or hair-like objects using the applicator of claim 9, the method comprising:

holding said handle of said applicator;

moving said applicator toward the surface until said shield touches the surface or the base portion of the hair or hair-like objects reaches the product shielded by said shield; and moving said applicator in a way such as along the hair or hair-like objects from the base to tip or along the surface from one position to another to transfer the product from said application member to the hair or hair-like objects.

15. A method for applying fluid or paste product to hair or hair-like objects using an applicator comprising a handle, an application member connected to said handle for applying fluid or paste product to the hair or hair-like objects, and a shield adapted to cover at least part of said application member to prevent the surface to which the hair or hair like objects are attached or adjacent from contacting said at least part of said application member covered by said shield, thereby reducing the risk of contaminating the surface with the product during the use of said applicator, and to allow the hair or hair-like objects to reach the fluid or paste product held by said at least part of said application member covered by said shield, thereby causing the hair or hair-like objects to be coated by the product, the method comprising:

selecting the hair or hair-like objects to be treated;

moving said applicator toward the surface until said shield touches or nearly touches the surface or the base portion of the hair or hair-like objects reaches the product held by said at least part of said application member covered by said shield;

moving said applicator in a way such as along the hair or hair-like objects from base to tip or along the surface from one area to another to transfer the product from the application member to the hair or hair-like objects.

16. A method as defined in claim 15 wherein said shield of said applicator is movable relative to said handle of said applicator.

17. A method as defined in claim 15 wherein said shield has at least one opening configured to allow the hair or hair-like objects to pass through but to prevent the surface to pass through.

18. A method as defined in claim 15 wherein said shield is configured to separate hair or hair-like objects thereby allowing the hair or hair-like objects, which tends to adhere to each other after being coated with the product, to be separated or combed during the step of moving said applicator in a way such as along the hair or hair-like objects from base to tip or along the surface from one area to another.

19. A method as defined in claim 15 further comprising a step of moving said handle to ensure that said shield is between the surface to which the hair or hair like objects are attached or adjacent and said application member prior to the step of moving said applicator toward the surface.

20. A system for use in the treatment of hair or hair-like objects with a fluid or paste product comprising:

an application member adapted to hold an amount of fluid or paste product and to transfer product to hair or hair-like objects;

a handle connected to said application member;

a product loading system for loading fluid or paste product to said application member;

a shield adapted to be in a first position, in which said shield is away from said application member, and in a second position, in which said shield covers at least part of said application member for impeding the contamination or smudging of the surface to which the hair or hair-like objects are attached or adjacent by the product held by said at least part of said application member covered by said shield, said shield having at least one opening dimensioned or shaped to allow hair or hair-like objects to reach the fluid or paste product held by said at least part of said application member covered by said shield, thereby causing the hair or hair-like objects to be coated with the product.

21. A system as defined in claim 20 further comprising a spring for moving said shield between said first and second positions.

22. A system as defined in claim 20 wherein said shield further comprises a base for mounting said shield to said application member.

23. A system as defined in claim 20 wherein said product loading system is adapted to load the product to said application member when said shield is in said first position, said product loading system comprising a container for a supply of product having a inlet and a wiper mounted at said inlet, said handle enabling said application member to be inserted into said container and withdrawn therefrom in such a way that excess product is wiped off said application member at said wiper.

24. A system as defined in claim 20 wherein said product loading system comprises a container for a supply of product having a inlet and a wiper mounted at said inlet, said handle enabling said application member to be inserted into said container and withdrawn therefrom in such a way that excess product is wiped off said application member at said wiper, said inlet serving to move said shield to said first position.

25. A system as defined in claim 20 further comprising a cleaner having an opening for receiving said shield, said opening being dimensioned to allow said shield to contact said cleaner to clean said shield.

26. A system as defined in claim 20 wherein said shield comprising a plurality of thin members for forming said at least one opening.

27. A system as defined in claim 26 wherein said plurality of thin members and said at least one opening are shaped or dimensioned to separate or comb hair or hair-like objects.

28. A system as defined in claim 20 wherein said shield further comprising a base and a substantially coil-shaped thin member attached to said base, said at least one opening being formed between adjacent turns of said substantially coil-shaped thin member.

29. A system as defined in claim 20 wherein said shield further comprising a plurality of protrusions or tines for combing hair or hair-like objects.

30. A system as defined in claim 20 further comprising a plurality of application members and a plurality of seal containers for sealing said application members after said product loading system has loaded said application members with product thereby preventing the product on said application members from hardening.

31. A system for use in the treatment of hair or hair-like objects with a fluid or paste product comprising:

a product container for containing a supply of fluid or paste product;

at least one applicator, each said applicator comprising a handle, an application member connected to said handle for holding fluid or paste product and applying the product to hair or hair-like objects, and a shield for covering at least part of said application member to prevent the surface to which the hair or hair-like objects are attached or adjacent from contacting said at least part of said application member covered by said shield during the use of said applicator, thereby impeding the contamination of the surface by said application member, and for allowing hair or hair-like objects to penetrate said shield and reach the product held by said at least part of said application member covered by said shield, thereby allowing the hair or hair-like objects to be coated with the product; and a product loading system for loading the fluid or paste product from said product container selectively to said application member while leaving said shield substantially free of the product.

32. A system as defined in claim 31 wherein said shield is movable.

33. A system as defined in claim 31 wherein said product loading system comprises a second container for containing said application member, a pump for dispensing an amount of product from said product container via a passageway to said second container, and a distributor for distributing said amount of product to said application member and removing excess product.

34. A system as defined in claim 33 wherein said product container is formed in said handle.

35. A system as defined in claim 31 wherein said product loading system comprises a passageway for fluid communication between said product container and said application member, said application member containing capillary openings for drawing product by capillarity or capillary force from said product container to said application member via said passageway.

36. A system as defined in claim 35 wherein said application member comprises a porous structure such as a foam, felt, flocking, sintered particles or a fiber assembly.

37. A system as defined in claim 35 wherein said application member comprises a body having said capillary openings, said capillary openings being formed by structures such as tines or grooves on said body.

38. A system as defined in claim 35 wherein said product loading system further comprises a fluid keeper for preventing the fluid in said container from flowing out of said application member as a result of gravity.

39. A system as defined in claim 38 wherein said fluid keeper comprises a porous structure.

40. A system as defined in claim 38 wherein said fluid keeper is adapted to maintain the product in said product container under a slight vacuum.

41. A system as defined in claim 31 wherein said shield has at least one opening configured to allow the hair or hair-like objects to penetrate while to prevent the surface from penetrating.

42. A system as defined in claim 41 wherein said shield further comprises a plurality of thin members for forming said at least one opening, said plurality of thin members and said at least one opening being configured to separate or comb hair or hair-like objects.

43. A system as defined in claim 41 wherein said product loading system comprises an inlet for said product container and a wiper mounted at said inlet, said inlet being configured to allow said application member to be inserted into said container and withdrawn therefrom in such a way that excess product is wiped off said application member at said wiper and to prevent said shield from entering said product container thereby preventing said shield from being loaded with the product.

44. A system as defined in claim 31 wherein said application member comprises a body and a plurality of protrusions such as tines or ring-like discs on said body.

45. A system as defined in claim 44 wherein said shield comprises a plurality of thin members located on the top of at least some of said plurality of protrusions, said plurality of thin members being configured to prevent the surface from contacting said protrusions while to allow the hair or hair-like objects to contact said protrusions.

46. A system as defined in claim 45 wherein said product loading system comprises a pump for dispensing an amount of product from said product container via a passageway towards said application member and a distributor for distributing said amount of product to said application member and removing excess product.

47. A system as defined in claim 46 wherein said distributor comprises at least one distributor head, each said distributor head having a free edge configured to apply the product to said protrusions and removing excess product.

48. A system as defined in claim 47 wherein each said at least one distributor head is adapted to move according to a predetermined path along said application member for applying product to said application member.

49. A system as defined in claim 47 wherein said distributor comprises a chamber for confining said amount of product from said pump and preventing it from reaching said thin members.

50. A system as defined in claim 31 further comprising a plurality of scraping members for removing hardened or partially hardened product from said application member.

51. A system as defined in claim 31 further comprising a second container and a cleaner located near the entrance of said second container, said cleaner having an elongated opening for allowing said application member and said shield to pass through to enter said second container and allowing said shield to contact said cleaner to cause said shield to be cleaned.

52. An system as defined in claim 31 wherein said product loading system comprises a product dosage indicator for indicating to the user the amount of product delivered for a particular application and a product level indicator for showing the user the amount of product remaining in said container.

53. An system as defined in claim 31 wherein said product loading system comprises a piston adapted to move from one end to the other end of said product container as said product loading system delivers the product from said container towards said application member and a see-through strip between said ends to show the position of said piston, thereby indicating the amount of product in said container.

54. A system as defined in claim 31 further comprising at least one seal container for sealing said at least one applicator to prevent the product loaded to said application member by said product loading system from hardening.

55. A system as defined in claim 54 wherein said seal container comprises a chamber for containing said applicator and a barrier film for sealing said chamber, said chamber being configured to minimize the movement of said applicator therein and to provide a predetermined space between the product on said application member uncovered by said shield and the interior surface of said film and chamber, thereby minimizing the contamination of said seal container by the product on said application member.

56. A system as defined in claim 54 wherein said seal container comprises a flexible barrier film for forming a chamber to enclose said applicator, said chamber being configured to minimize the movement of said applicator therein and to provide a predetermined space between the product on said applicator member uncovered by said shield and the interior surface of said chamber, thereby minimizing the contamination of said seal container by the product on said applicator member.

57. A system as defined in claim 54 wherein said seal container comprises a predetermined amount of materials for preventing the product on said application member from hardening.

58. A method of applying paste or fluid product to hair or hair-like objects using the applicator of claim 31, the method comprising:

holding said handle of said applicator;

moving said applicator toward the surface until said shield touches the surface or the base portion of the hair or hair-like objects reaches the product on said at least part of said application member covered by said shield; and moving said applicator in a way such as along the hair or hair-like objects from the base to tip or along the surface from one position to another to transfer the product from said application member to the hair or hair-like objects.

59. A system for use in applying a fluid or paste product to or into an object comprising:

a container for containing a supply of fluid or paste product said container having a first and second ends;

an application member for receiving an amount of fluid or paste product from said container and for applying the product to or into the object;

a product passageway for delivery of the product from said container towards said application member;

a knob adapted to be turned by the user;

a piston adapted to move in said container between said ends;

an elongated member comprising an upper portion connected to said knob and a lower portion engaged with said piston for converting the turning or circular movement of said knob to linear movement of said piston in said container, thereby causing the delivery of product from said container towards said application member; and a product indicator comprising a product dosage indicator for indicating to the user the amount of product delivered for a particular application, said dosage indicator comprising a pointing mark, a plurality of graduated marks, and an one-way mechanism for preventing said knob from being turned at the direction to cause the product in said application member to return to said container, said pointing mark and said plurality of graduated marks being arranged to enable the turning of said knob to cause said pointing mark to point at a different position in said plurality of graduated marks.

60. A system for use in applying a fluid or paste product to or into an object comprising:

a container for containing a supply of fluid or paste product, said container having a first and second ends;

an application member for receiving an amount of fluid or paste product from said container and for applying the product to or into the object;

a product passageway for delivery of the product from said container towards said application member;

a knob adapted to be turned by the user;

a piston adapted to move in said container between said ends;

an elongated member comprising an upper portion connected to said knob and a lower portion engaged with said piston for converting the turning or circular movement of said knob to linear movement of said piston in said container, thereby causing the delivery of product from said container to wards said application member; and a product indicator comprising a product level indicator for showing the user the amount of product remaining in said container or the life of the system, said product level indicator comprising a sleeve having a chamber capable of receiving at least part of said container, an upper wall below said knob, and an opening at said upper wall for receiving the upper portion of said elongated member, said opening and elongated member being configured to allow rotational and prevent linear movement of said elongated member in said opening thereby enabling said sleeve to receive more of said container only as said knob is turned to cause said elongated member and piston to deliver the product out of said container, the percent of said container out of said sleeve serving to indicate the amount of product remaining in said container.

61. An applicator for applying fluid or paste product to hair or hair-like objects comprising:

a handle;

an application member adapted to hold an amount of fluid or paste product and to transfer the product to hair or hair-like objects;

an elongated connector having a first end connected to said handle and a second end connected to said application member;

a shield comprising a base for connecting said shield to said elongated connector, said base being operative to move about or along said elongated connector between a first position, in which said shield is away from said application member thereby allowing the loading of fluid or paste product to said application member, and a second position, in which said shield covers at least part of said application member; and a spring for moving said base between said first and second positions.

62. An applicator as defined in claim 61 wherein said shield further comprises at least one opening dimensioned or shaped to allow hair or hair-like objects to reach the product held by said application member, thereby causing the hair or hair-like objects to be coated by the product, and a plurality of protrusions such as tines for combing or separating the hair or hair-like objects.

63. An applicator for applying fluid or paste product to hair or hair-like objects comprising:

a handle;

an application member adapted to hold an amount of fluid or paste product and to transfer the product to hair or hair-like objects;

an elongated connector having a first end connected to said handle and a second end connected to said application member; and a shield comprising a base for connecting said shield to said elongated connector, said base being operative to move about or along said elongated connector between a first position, in which said shield is away from said application member thereby allowing the loading of fluid or paste product to said application member, and a second position, in which said shield covers at least part of said application member, and at least one opening configured to allow hair or hair-like objects to pass through and to prevent the surface to which the hair or hair-like objects are attached to adjacent from passing through.

64. An applicator as defined in claim 63 wherein said shield further comprises a plurality of protrusions such as tines for combing or separating the hair or hair-like objects.

65. An applicator for applying fluid or paste product to hair or hair-like objects comprising:

a handle;

an application member adapted to hold an amount of fluid or paste product and to transfer the product to hair or hair-like objects;

an elongated connector having a first end connected to said handle and a second end connected to said application member;

a shield comprising a base for connecting said shield to said elongated connector, said base being operative to move about or along said elongated connector between a first position, in which said shield is away from said application member thereby allowing the loading of fluid or paste product to said application member, and a second position, in which said shield covers at least part of said application member; and a container for a supply of product having an inlet and a wiper mounted at said inlet, said inlet preventing said shield from entering said container and allowing said application member to be inserted into said container and withdrawn therefrom in such a way that excess product is wiped off said application member at said wiper.

66. An applicator as defined in claim 65 wherein said shield further comprises at least one opening dimensioned or shaped to allow hair or hair-like objects to reach the product held by said application member, thereby allowing the hair or hair-like objects to be coated by the product.

67. An applicator as defined in claim 65 wherein said shield further comprises a plurality of protrusions such as tines on the outer surface of said shield for combing or separating the hair or hair-like objects.

68. An applicator for applying fluid or paste product to hair or hair-like objects comprising:

a handle;

an application member adapted to hold an amount of fluid or paste product and to transfer the product to hair or hair-like objects;

an elongated connector having a first end connected to said handle and a second end connected to said application member; and a shield comprising a base for connecting said shield to said elongated connector, said base being operative to move about or along said elongated connector between a first position, in which said shield is away from said application member thereby allowing the loading of fluid or paste product to said application member, and a second position, in which said shield covers at least part of said application member, and an elongated member connected to said base, said elongated member having a first surface for covering at least part of said application member and a second surface on which a plurality of tines are formed for combing or separating hair or hair-like objects.

69. An applicator as defined in claim 68 wherein said elongated member comprises at least one opening dimensioned or shaped to allow hair or hair-like objects to reach the product held by said application member, thereby allowing the hair or hair-like objects to be coated by the product.

70. An applicator for applying fluid or semi-fluid product to hair or hair-like objects comprising:

a container for containing a supply of fluid or paste product;

an application member for applying fluid or semi-fluid product to hair or hair-like objects; and a shield for covering at least part of said application member, said shield comprising at least one opening configured to allow hair or hair-like objects to reach the product at said application member, thereby causing the hair or hair-like objects to be coated by the product, and to prevent the surface to which the hair or hair-like objects are attached or adjacent from contacting the product at said at least part of said application member covered by said shield, thereby impeding or preventing the contamination of the surface by the product.

71. An applicator as defined in claim 70 wherein said container is formed in said application member.

72. An applicator as defined in claim 70 wherein said application member contains capillary openings for drawing product from said container to said application member.

73. An applicator as defined in claim 70 wherein said application member and said shield are movable relative to each other.

74. An applicator as defined in claim 70 wherein said container comprises an inlet adapted to allow said application member to enter said container and reach the product therein.

75. An applicator as defined in claim 70 wherein said shield further comprising a plurality of thin members for forming said at least one opening.

76. An applicator as defined in claim 75 wherein said plurality of thin members and said at least one opening are configured to separate or comb hair or hair-like objects.

77. An applicator as defined in claim 70 wherein said shield further comprises a plurality of protrusions such as tines for forming a comb.

78. An applicator as defined in claim 70 wherein said application member comprises a plurality of protrusions such as tines or ring-like discs and said shield comprises a plurality of thin members formed on the top of at least some of said plurality of protrusions.

79. An applicator as defined in claim 70 further comprising means for preventing the product in said container from flowing out of said application member as a result of gravity and a passageway for connecting said container to said application member.

80. An applicator as defined in claim 1 wherein said shield further comprises a plurality of thin members such as tines or rings, each said thin member having a first end extended out of said application member and a second end connected to said application member, said thin members being so arranged that the spaces among said thin members form said openings.

81. An applicator as defined in claim 1 further comprising a cleaner for cleaning said shield when said shield become contaminated by the product.

82. An applicator as defined in claim 1 wherein said shield further comprising a base and a substantially coil-shaped member attached to said base, said at least one opening being formed between adjacent turns of said substantially coil-shaped member.

83. An applicator as defined in claim 1 further comprising a seal container for sealing said applicator, said container being configured to minimize the movement of said applicator therein and to provide a space between the product on said application member and the interior surface of said container, thereby minimizing the contamination of said container by the product on said application member.

84. A shield for an applicator having a handle and an application member connected to said handle for holding an amount of fluid or paste product and applying the product to hair or hair-like objects, said shield being adapted to cover at least part of the application member and comprising a first surface adapted to face the surface to which the hair or hair-like objects are attached or adjacent during the use of the applicator, a second surface opposing said first surface adapted to face the application member, and at least one opening dimensioned or shaped to allow hair or hair-like objects to reach the fluid or paste product held by said application member, thereby causing the hair or hair-like objects to be coated by the product, and to prevent the surface from contacting said application member through said at least one opening, thereby reducing the risk of contamination or smudging of the surface by the product on said application member.

85. A shield as defined in claim 84 further comprising a plurality of thin members connected to the application member, said plurality of thin members being so arranged that the space or spaces between said thin members form said at least one opening.

86. A shield as defined in claim 84 further comprising a base to allow a user to removably mount said shield to the applicator for covering at least part of the application member.

87. A shield as defined in claim 84 further comprising a base to connect said shield to the applicator, said base being adapted to be movable relative to the handle of the applicator.

88. A shield as defined in claim 84 further comprising a plurality of thin members for forming said at least one opening, said thin members being configured to comb hair or hair-like objects.

89. A shield as defined in claim 84 further comprising a plurality of protrusions such as tines or rings, each said protrusion having a first end extended out of said application member and a second end connected to said application member, said protrusions being so arranged that the spaces among said protrusions form said openings, said first ends of said protrusions form said first surface and said second ends of said protrusions form said second surface.

90. An applicator as defined in claim 1 wherein said application member comprises tines or rings to retain the product between said tines or rings and said shield comprises a plurality of thin members connected to at least some of said tines or rings, said thin members being so configured that the space or spaces between said thin members form said at least one opening.

91. An applicator as defined in claim 90 further comprising an amount of paste or fluid product confined between said tines or rings and a seal container for sealing at least said application member and said shield to prevent the hardening of said product.

92. An applicator as defined in claim 1 wherein said application member and said shield are movable relative to each other.

93. An applicator as defined in claim 1 further comprising a container for containing a supply of fluid or paste product, said container comprising an inlet adapted to allow said application member to enter said container to be loaded with the product.

* * * * *